United States Patent [19]

Fröhling et al.

[11] Patent Number: 4,765,406

[45] Date of Patent: Aug. 23, 1988

[54] METHOD OF AND APPARATUS FOR INCREASING THE MOBILITY OF CRUDE OIL IN AN OIL DEPOSIT

[75] Inventors: Werner Fröhling, Düren; Manfred Kugeler; Kurt Kugeler, both of Jülich; Peter W. Phlippen, Geilenkirchen, all of Fed. Rep. of Germany.

[73] Assignee: Kernforschungsanlage Julich Gesellschaft mit beschrankter Haftung, Julich, Fed. Rep. of Germany

[21] Appl. No.: 39,605

[22] Filed: Apr. 16, 1987

[30] Foreign Application Priority Data

Apr. 17, 1986 [DE] Fed. Rep. of Germany ..... 3612946

[51] Int. Cl.[4] ..... E21B 43/24; E21B 43/38

[52] U.S. Cl. ..... 166/247; 166/57; 166/265; 166/300; 166/302; 166/303; 165/45

[58] Field of Search ..... 166/57, 247, 272, 302, 166/303, 300, 265; 60/641.2, 641.3, 641.8; 165/45

[56] References Cited

U.S. PATENT DOCUMENTS

| | | | |
|---|---|---|---|
| 1,126,215 | 1/1915 | Hildebrand | 166/302 |
| 3,150,716 | 9/1964 | Strelzoff et al. | 166/272 |
| 3,237,689 | 3/1966 | Justhiem | 166/302 X |
| 3,386,508 | 6/1968 | Bielstein et al. | 166/303 X |
| 3,410,347 | 11/1968 | Triplett et al. | 166/302 X |
| 3,952,802 | 4/1976 | Terry | 166/302 X |
| 4,154,297 | 5/1979 | Austin | 166/302 X |
| 4,243,098 | 1/1981 | Meeks et al. | 166/303 X |
| 4,372,386 | 2/1983 | Rhoades et al. | 166/303 X |
| 4,444,257 | 4/1984 | Stine | 166/303 X |
| 4,546,829 | 10/1985 | Martin et al. | 166/303 X |
| 4,706,751 | 11/1987 | Gondouin | 166/272 |

*Primary Examiner*—George A. Suchfield
*Attorney, Agent, or Firm*—Herbert Dubno

[57] ABSTRACT

Test recovery of crude oil by injection of a heat carrier into the oil stratum is effected by generating thermal energy in the crude oil deposit or at a location at which a well enters this deposit by carrying out a catalytic methanization reaction and transferring the resulting heat to the heat carrier which can be steam or an inert gas. The heat carrier then is introduced into the crude oil stratum and increases the mobility of the crude oil.

6 Claims, 3 Drawing Sheets

METHOD OF AND APPARATUS FOR INCREASING THE MOBILITY OF CRUDE OIL IN AN OIL DEPOSIT

FIELD OF THE INVENTION

Our present invention relates to a method of and apparatus for promoting the extraction of crude oil from an oil field and, more particularly, to a method of and apparatus for increasing mobility of crude oil in a deposit or field thereof in which the crude oil may be trapped.

BACKGROUND OF THE INVENTION

While some oil may be extracted from crude oil deposits under intrinsic pressure, most oil must be pumped to the surface and, because of the viscosity of the crude oil, it is advantageous to increase the mobility thereof by injecting heat-carrying fluid into the deposit.

The recovery of oil thus can be accomplished by so-called primary and secondary methods which generally can recover about 35% on average of the crude oil contained in the deposit.

For this reason, it is common to provide so-called tertiary processes to increase the yield or product of an oil field.

Various chemical and physical principles are used in tertiary mobilization of crude oil. In one approach, steam is injected. The steam forms a heat carrier and displacement medium. The increase in temperature in the oil field reduces the viscosity of the crude oil and thus allows its flow or transport to the extraction well more readily. The injection of steam also has the advantage that it increases the pressure in the deposit and thus facilitates the displacement of crude oil to the surface and from the regions in which the steam is introduced.

To generate the steam which is injected into an oil field, it is customary to provide relatively small steam generating plants which are placed as close as possible to the injection well. Using insulated distribution pipes for the heated steam, the latter is delivered to a variety of injection wells generally located around the extraction well.

The distribution piping, even though insulated, should be as short as possible to minimize capital costs and heat losses.

Using special injection pipes, the steam can be introduced into the deposit and, for example, one can inject the steam through the same well from which oil is extracted or through wells remote from the extraction well. The injection systems which are used are generally also quite complicated, since they may require well casings of special design, insulated steam-supply pipes which are also referred to as tubings and specially insulated couplings between the tubings which may be provided with annular compartments between special means for maintaining the space between tubings and casings relatively dry, all designed so that the heat loss from the steam in its travel to the subterranean deposit is as low as possible.

These steam injection systems are not without disadvantages. A principal drawback is that the heat losses are practically unavailable not only in the distribution piping between the steam generator plant and the injection wells, but also in the injection tubings, the losses increasing in a greater than proportional way with the depth of the deposit and hence the length of the well.

The heating of the casing or well lining from the heat emitted by the steam injection ducts provides additional stress.

To accommodate the mechanical strain applied to the system, relatively expensive techniques must be used, e.g. the casing may have to be prestressed.

In general, the equipment of well with a steam injection duct is for more expensive and complicated than the usual well piping.

It appears, therefore, that the problems involved with steam injection as a tertiary method of crude oil mobilization are bound in large measure to the fact that heretofore the steam generating plant was required to be at grade level. Even greater problems may be encountered if the technique is to be used an ocean-pumping rigs and platforms, where space is at a premium and the provision of a steam generating plant on a platform and the use of insulated ducts can cause serious difficulties with respect to access and available space problems.

OBJECTS OF THE INVENTION

It is, therefore, the principal object of the present invention to provide a method of mobilizing crude oil in a deposit thereof which eliminates the problems of heat loss discussed above and greatly simplifies the use cf an injected heat carrier for tertiary crude oil recovery.

Another abject of the present invention is ta provide a simplified apparatus for injecting a heat carrier into an oil field.

Still another object of the present invention is to provide a method of and apparatus for the injection of a heat carrier, such as steam, into a crude oil deposit which does not require a steam generating plant at the surface or on the oil-drilling or oil-recovery platform, minimizes problems with respect to insulated piping, and allows a considerable simplification in the manufacture of recovery systems for emptying recovery wells.

SUMMARY OF THE INVENTION

These objects and others which will become more readily apparent hereinafter are attained, in accordance with our invention, in a method of increasing the mobility of crude oil in a deposit thereof wherein a fluid heat carrier, e.g. steam, is introduced at an inlet region into the deposit, the heat carrier being formed or heated by forming a methanizable synthesis gas and heating the fluid carrier below grade at least in part by catalytically methanizing the methanizable synthesis gas at a location which may be at the region at which the heat carrier enters the deposit or a location within the interior of that deposit, the catalytic methanizatian being carried out at least in part by heat exchange with the heat carrying fluid.

Since the heating of the heat carrier is carried out directly within the deposit itself or at the inlet region (where the well enters the deposit) by catalytic methanization of a methanizable synthesis gas, the heat evolved in that catalytic reaction serves to heat the heat carrier which in turn, under heat and pressure, mobilizes the oil like the injected steam of the tertiary recovery systems previously described.

The invention allows the supply piping to deliver cool synthesis gas to the deposit so that insulated pipes are not required, the synthesis gas only then being transferred into methane in the catalytic reactor to generate the heat which is required to produce the steam forming the heat carrier.

The reaction heat is transformed to the heat carrier so that only at the entrance to or within the deposit itself and certainly no later than the end of the well is the heat carrier brought to the temperature required for the tertiary recovery of the crude oil.

The quality of the steam at the entrance to the deposit is thus not reduced by condensation processes resulting from long transport paths. The piping used for the heat carrier, which can be water, before it is transformed into steam, can also be insulated and because neither the synthesis gas nor the heat carrier piping need be insulated, the overall structure is greatly simplified, the systems can be more readily assembled, disassembled or changed, parts of the system can be shifted, all with considerably greater ease than with the systems which required long distance piping of steam or the like.

The location of the synthesis gas generator can be selected independently of the location of the deposit and can, indeed, be quite remote therefrom. The advantages are particularly great for offshore drilling and piping rigs and platforms.

Methanization of synthesis gas and its use as a source of energy is, of course, known (see German patent No. 1,298,233). The synthesis gas is generated by steam reformation and is methanized in an energy consuming unit. The resulting product gas is recycled and reformed into synthesis gas. This product has been the subject of some research, see R. HARTH et al, "Die Versuchsanlage EVA II/ADAM II, Beschreibung van Aufbau und Funktian", Bericht der Kernfarschungsanlage Jülich, Jül—1984, Mar. 1985, and H. HARMS et al, "Methanisierung kahlenmanaxidreicher Gase beim Energietranspart", Chem.-Ing.-Tech. 52, 1980. Na. 6, S. 504 ff.

According to a feature of the invention, the product gas produced by the methanization is withdrawn from the region of the crude oil deposit and is transformed by means of steam reforming into synthesis gas. Thus a closed cycle is established in which the synthesis gas is subjected to methanization in the methanization reactor and the product of the methanization operation is used to regenerate the synthesis gas, heat being contributed to crack the product gas.

According to a feature of the invention, steam is used as the heat carrier, since it can serve both to raise the temperature of the crude oil in the deposit and elevate the pressure in the deposit for the purposes described.

To avoid the formation of excess condensate in the deposit, it is also possible to use as the heat carrier an inert gas which does not condense upon cooling, e.g. carbon dioxide or nitrogen.

Mixtures of steam and inert gas may also be used.

According to the apparatus aspects of the invention, a heater for the heat carrier is provided in or proximal to the entry of the well into the deposit and is supplied with the heat carrier through the well by appropriate piping. This heater is formed with a methanization reactor for the catalytic methanization of the methanizable synthesis gas. Advantageously, the reactor and the heat exchanges are located in the well where it enters the deposit.

To further utilize the heat generated by the methanization in the methanization reactor, upstream of the latter in the flow direction of the heat carrier there is provided a preheater and further upstream, a condenser.

In the preheater, we effect a heat exchange between upwardly flowing product gas and downwardly flowing synthesis gas. In the condenser, we provide for the cooling of the product gas below the dew-point thereof, i.e. to a temperature which is equal to or less than the condensation temperature of the water vapor contained in the product gas, thereby imparting additional heat to the synthesis gas including heat released by condensation.

Advantageously, the methanization reactor is connected with a steam-reforming plant in which the product gas is reconverted into synthesis gas and delivered to the methanization reactor to heat the product gas before the reformation. We can use a variety of energy sources including coal, oil, gas-fired heaters, solar energy plants and the like, although we preferably make use of a high temperature nuclear reactor.

BRIEF DESCRIPTION OF THE DRAWING

The above and other objects, features and advantages of the present invention will become more readily apparent from the following description, reference being made to the accompanying highly diagrammatic drawing, in which.

SPECIFIC DESCRIPTION

Figure 1:
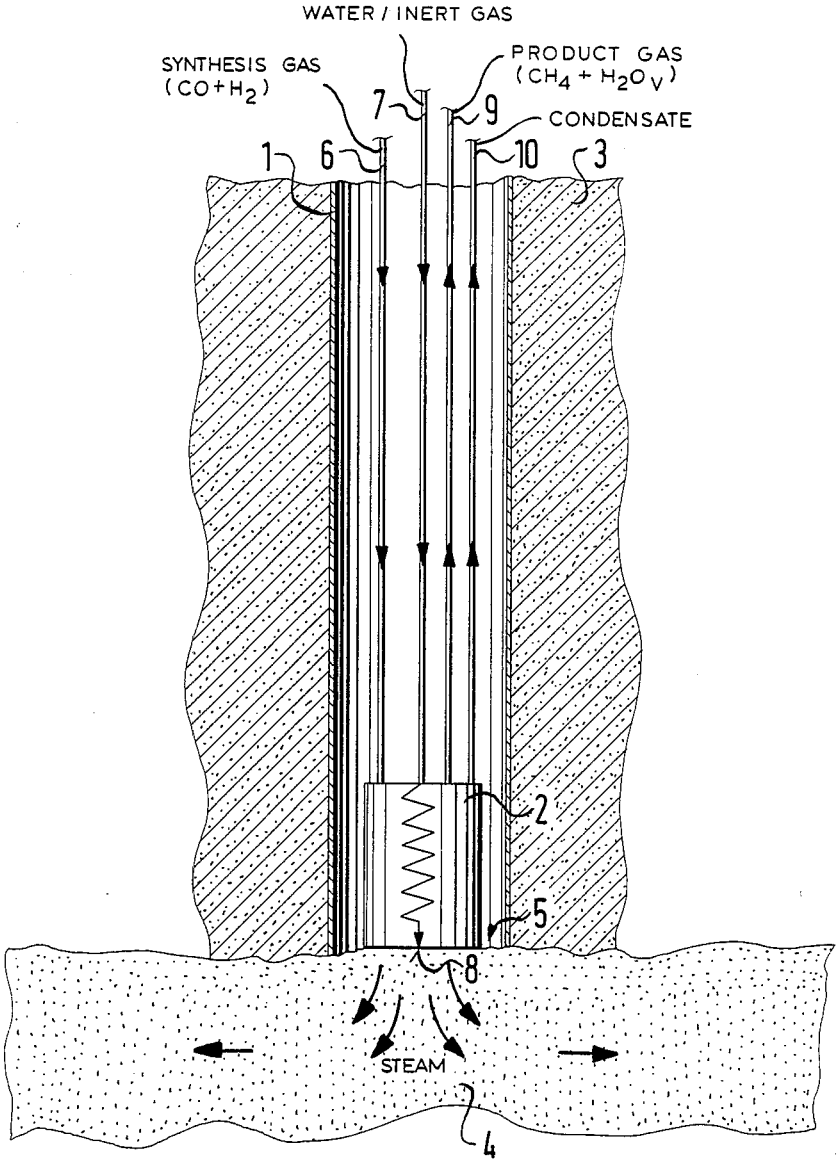
FIG. 1 is a highly diagrammatic vertical cross-sectional view illustrating the principles of the invention and showing the use of a subterranean methanization reactor located at the foot of the well at the point at which it enters the oil deposit stratum of the oil field.

FIG. 1 in highly diagrammatic form shows a cased well provided at the bottom or foot thereof with a methanization apparatus 2 (see FIG. 2) including a methanization reactor.

The methanization apparatus is located in the rock structure, dome or roof 3 of the crude oil containing deposit or stratum 4. The methanization apparatus is thus located directly in the region 5 at which the cased bore opens into the crude oil stratum 4 and immediately above the latter.

A synthesis gas pipe 6 delivers the synthesis gas to the methanization plant 2 which is also supplied with the heat carrier, e.g. water or inert gas via the line 7.

The media traversing the lines are cool, i.e. at room or ambient temperature so that they need not be insulated to avoid the loss of heat, the lines run uninsulated to the methanization apparatus 2.

The synthesis gas can consist predominately of carbon monoxide and hydrogen, although traces of product gas and other gases may also be present.

In the methanization unit 2, this synthesis gas is catalytically methanized, utilizing any conventional catalyst capable of exothermically transforming the synthesis gas to methane and water vapor. The reaction heat is used, by indirect heat exchange, to heat the heat carrier, which in the case of water, is converted to steam and is discharged at 8 into the crude oil deposit 4 to heat the crude oil.

The product gas produced by the methanizatian reactor is withdrawn at 9 after moisture has been condensed therefrom and condensate, which is deposited out, is withdrawn via the line 10.

Figure 2:
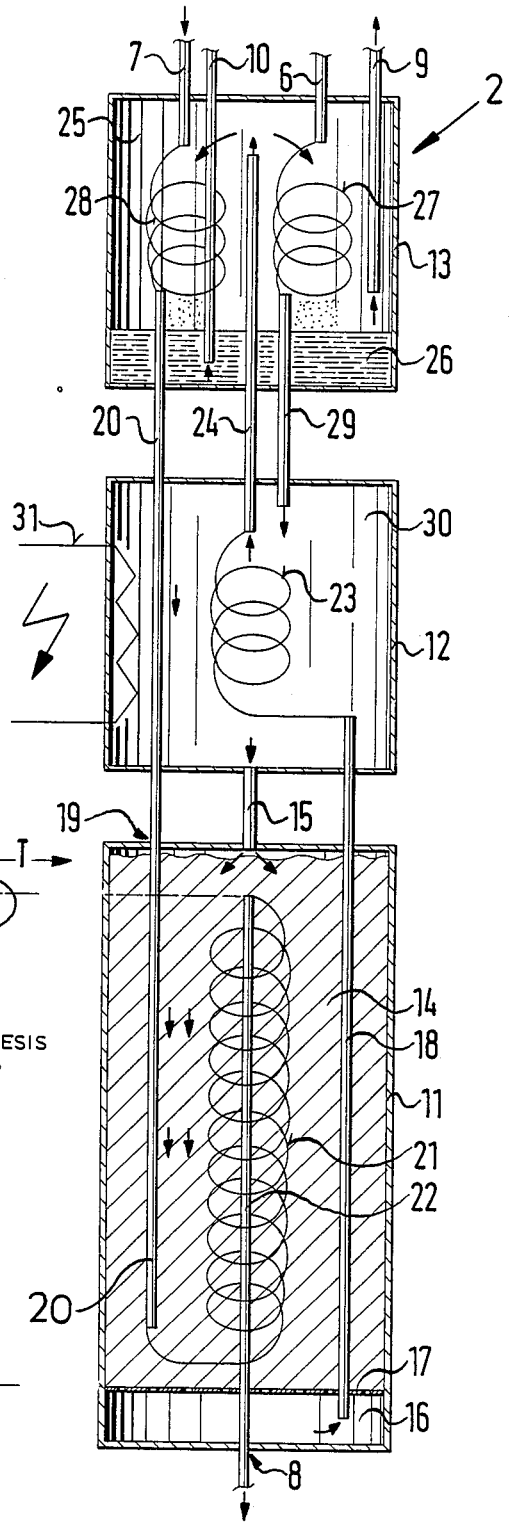
FIG. 2 is a diagrammatic axial sectional view illustrating a methanization reactor with associated elements which can be used in the application seen in FIG. 1.
Figure 2A:
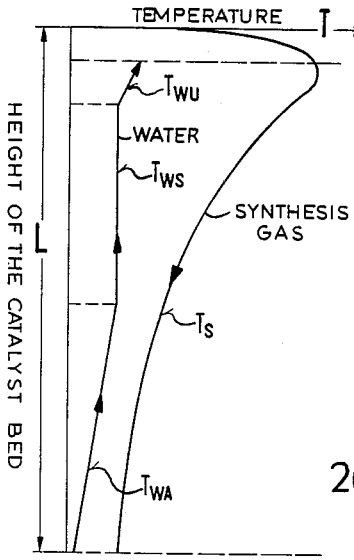
FIG. 2A is a graph showing the temperature profile along the length of the catalyst bed of the methanization reactor.

The construction of the subterranean methanization plant 2 has been shown in greater detail in FIG. 2.

The methanization plant comprises a methanization reactor 11, a preheater 12 and a condenser 13.

The methanization reactor 11 is located at the deepest point in the well 1. It comprises a methanization-catalyst-filled catalyst compartment 14.

The synthesis gas flows through the catalyst compartment from the synthesis gas inlet 15 to the gas collection space 16 at the bottom of the methanization reactor 11, the gas collection space 16 being separated from the catalyst space 14 by a perforated bottom or grate 17 which is permeable to the product gas formed by the methanization.

An outlet pipe 18 for the product gas is connected to the preheater 12 of the methanization plant 2. The preheater 12 is located in the well above the methanization reactor 11.

The heat carrier which is heated in the methanization reactor 11.

The heat carrier which is heated in the methanization reactor 11 indirectly is fed via line 7 to the condenser and ultimately is delivered to the heat carrier inlet 19 of the methanization reactor. A heat exchange line 20 extends firstly downwardly practically to the gas collection space 16 and the enters a coil 21 embedded in the catalyst. In the outlet of this coil is a central pipe 22 which opens at 8 into the crude oil deposit.

Thus in the methanization reactor, the heat carrier is heated, mast intensively at the upper end of the coil and is then immediately discharged into the crude oil stratum 4 so that the heat carrier can transfer heat to this stratum and the crude oil therein, increase the mobility and decrease the viscosity thereof and hence improve crude oil recovery.

The residual heat in the product gas after the heat carrier has been heated, is used to preheat the synthesis gas supplied to the methanization reactor 11 and to preheat the heat carrier.

For this purpose, the preheater 12 is provided upstream of the methanization reactor and a condenser 13 is provided upstream of the methanization reactor and a condenser 13 is provided upstream of the preheater with respect to the direction of flow of the heat carrier.

The preheater 12 is located directly ahead of the methanization reactor 11 and has a heat exchanger part 23, shown as a coil, which is traversed by the product gas collected via pipe 18 from the space 16. The synthesis gas is delivered to the space 30 surrounding the coil 23 via a downcomer 29 and a riser 24 delivers the product gas to the space 25 of the condenser 13.

The condensate 26 which separates from the product gas when the latter is cooled to or below the condensation temperature of water, can be drawn off via pipe 10 which has previously been discussed.

The heat liberated by condensation is transformed in part to the synthesis gas which passes from pipe 6 via coil 27 through the condenser to discharge via the downcomer 29 into the preheater 12.

The heat carrier, e.g. water or the inert gas is also preheated, e.g. in the coil 28 as it traverses the condenser and passes through the preheater 12 before entering at 19 the heat exchanger 20, 21, 22 in the methanization reactor.

Condensate from the coils 27 and 28 is collected at 26 to be pumped off via the line 10.

The synthesis gas and the heat carrier thus traverses the condenser 13 and preheater 12 via separate duct systems. In condenser 13, the synthesis gas passes via the coil pipe 27 in its coil while the heat carrier passes through the coil pipe 28.

Both of these pipe systems are in contact with the product gas in the condenser space 25 for heat transfer from the product gas which freely flows around the coils, to the synthesis gas and heat carrier.

The downcomer 29 connected to the coil 27 opens into the free space 30 of the preheater whereas the heat carrier passes through the latter for indirect heat exchange therein. An electric starting heater 31 is provided in the preheater chamber 30 to raise the synthesis gas to the reaction temperature in the starting phase of the reaction.

Once the methanization process has commenced and product gas is generated, the starting heater 31 can be cutoff.

SPECIFIC EXAMPLE

The synthesis gas is supplied at a temperature of about 20° C. and a pressure of about 20 to 40 bar to the methanization plant.

In the condenser and the preheater, it is then brought to a reactor temperature between 250° and 300° C. As a heat carrier for the heating of the crude oil, water vapor is here used which is introduced at a temperature of 320° C. and a pressure of up to 150 bar into the crude oil stratum. The crude oil stratum is located 1500 m below grade and the methanization plant is likewise located 1500 m below the surface.

The temperature profile in the methanization reactor with respect to the synthesis gas side and the water side are shown in separate curves in which the temperature is plotted against the heat of the catalyst bed.

Initially the temperature $T_S$ at the synthesis gas side increases rapidly to reach a maximum at the hot-spot region which corresponds to the point at which the superheated steam is discharged into the bed. In the flow direction of the product gases, the temperature falls off gradually from this hot-spot.

The temperature in the catalyst space is so controlled, that a predetermined maximum temperature is not exceeded. In operation, this maximum temperature should not exceed about 700° C.

The feed water which is fed via line 7 at 20° C. and at the lowest point, at about 1500 m from the surface has a pressure of about 150 bar, is heated in the condenser and in the passage 20 of the heat exchanger in the methanization reactor to a temperature of about 200° C. and then is further heated. The temperature profile of the water side thus shows an increase ($T_{WA}$) until the evaporation temperature ($T_{WS}$) is reached, at which time it absorbs heat as vapor is produced. At the hot-spot the superheated steam ($T_{WU}$) at a temperature of about 320° C. and a pressure of about 150 bar is fed to the oil-containing stratum.

The product gas which is withdrawn from the methanization reactor 11 via line 16 and consists essentially of methane, water vapor and unreacted synthesis gas components has a temperature between 300° and 320° C.

It is cooled in the preheater 12 and condenser 13, leaving the latter at a temperature of about 40° C. which is well below the dew point of the entrained water vapor.

Under the conditions described, 7 metric tons of steam are produced per hour from approximately 12,000 $m^3$ STP of synthesis gas. The methanization reactor for this purpose has a catalyst space 14 with a diameter of about 430 mm and a height of about 8 m.

Figure 3:
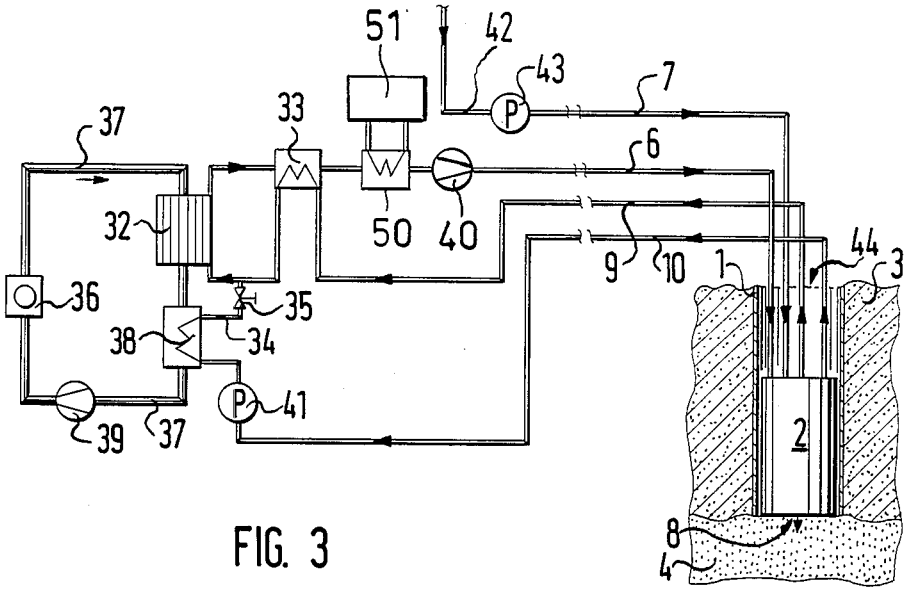
FIG. 3 shows the apparatus of FIG. 1 and its connection to a steam-reformatian plant for generating the synthesis gas.

FIG. 3 shows the remaining parts of the apparatus which may be used in conjunction with the methanization plant 2 is delivered by product gas line 9 to a steam reforming unit 32.

Before it enters this steam reformer, the product gas must be preheated in the heat exchanger 33 with hot synthesis gas flowing from the reformer 32.

To the product gas, water vapor is fed, the water vapor flowing via a steam line 34 with a control valve 35 into the product gas line 9.

To generate the synthesis gas from the product gas to which the water vapor has been added, it is necessary to supply heat to the reformer.

In the embodiment illustrated, the required heat is supplied by a high temperature nuclear reactor 36 whose cooling gas is passed through the steam reformer in indirect heat exchange therewith.

The cooling gas is preferably helium which is supplied to the reformer 32 from the high temperature nuclear reactor 36 in a cooling gas circulation at a temperature of about 950° C.

The residual heat of the cooling gas, after traversing the reformer, is used in a steam generator or waste-heat bailer 38 to generate the steam required for reaction with the product gas.

The steam pipe 34 is connected to the outlet of the steam generator 38.

The cooling gas is circulated by a blower 39 and enters the high temperature nuclear reactor 36 at a temperature of 300° C.

In the embodiment illustrated, the synthesis gas after steam reformation is not only used to preheat the product gas in heat exchanger 33. The residual heat is also supplied to a further heat exchanger 50 which can form part of an electric-power generating or water-preparation system 51. The synthesis gas can thus be cooled, firstly, from a temperature of about 600° C. to about 200° C. in the heat exchanger 33 and then by recovery of low temperature heat to about room temperature for delivery via line 6 to the methanization plant.

For the circulation of the synthesis and product gas between the methanization plant 2 and the steam reformer 32, we provide a compressor 40.

For the synthesis gas/product gas circulation, pressures of about 30 and 40 bar are required.

The condensed water collected from the condenser 13 and generated in the methanization plant can be used as shown for the production of steam for use in the steam reforming operation. A water pump 41 has the condensate pipe 10 connected to its intake side and displaces the water to the steam generator 34. A feedwater pump 43 can supply the water via line 42 which will ultimately be vaporized to form the heat carrier delivered to the well.

The lengths of the synthesis gas pipe 6, the product gas duct 9, the condensate pipe 10 and water line 42 are not critical, because all can work with room or ambient temperature and do not need thermal insulation.

Figure 4:
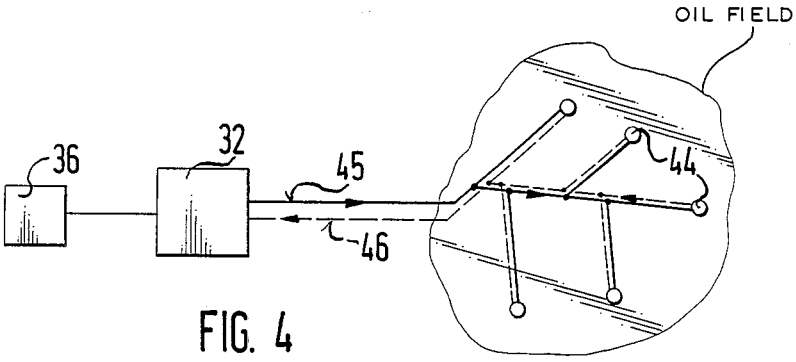
FIG. 4 is a plan view showing how the apparatus of FIG. 3 relates to a piping network for an oil field.

In FIG. 4, we have shown the steam reformation plant 32 and a number of wells 44 which are supplied with a heat carrier via the system described. The pipe networks are represented at 46 and can be seen to be principally located above ground. The pipe network 45 supplying the wells are shown in solid lines and return pipes 46 in broken lines. The nuclear reactor can be seen at 36.

Because of the fact that the methanization plant is located in the region of the crude oil stratum, it is possible to transport the energy carrier, the synthesis gas and the like over large distances without drawbacks which would be involved in the event that the pipes are insulated. For example, the synthesis gas generator can be 100 km or more from the oil fields which can be subjected to tertiary recovery utilizing the principal of the invention without significant difficulty. The thermal losses which have hitherto been a problem, no longer confront the process. If the amount of steam required for the regeneration process is not sufficient utilizing one methanization reactor or plant therein, of course, a plurality of such plants or reactors can be provided in a single well.

We claim:

1. In a method of increasing the mobility of crude oil in a subterranean deposit thereof wherein a fluid heat carrier is introduced at an inlet region into said deposit at a bottom of a well communicating with the deposit, the improvement which comprises the steps of:

(a) forming a methanizable synthesis gas by steam reformation; and (b) heating said fluid heat carrier at least in part by catalytically methanizing said methanizable synthesis gas at a location selected from said region and a location within the interior of said deposit and in heat exchanging relationship with said fluid heat carrier;

(c) recovering a product gas from the methanization of said methanizable synthesis gas;

(d) removing the recovered product gas from said deposit;

(e) passing the recovered product gas in heat exchange at said location with said methanizable synthesis gas flowing toward said location to heat said methanizable synthesis gas and cool said product gas substantially to a condensation temperature of water vapor therein;

(f) heating the removed and recovered product gas and subjecting it to steam reforming to transform the recovered product gas to synthesis gas; and (g) recycling the synthesis gas formed in step (f) to step (a).

2. The improvement defined in claim 1 wherein said fluid heat carrier is steam.

3. The improvement defined in claim 1 wherein said fluid heat carrier is an inert gas.

4. In a apparatus for increasing the mobility of crude oil in a subterranean deposit thereof which comprises means including a well communicating with said deposit for introducing a fluid heat carrier at an inlet region into said deposit, the improvement which comprises:

(a) means for forming a methanizable synthesis gas by steam reformer;

(b) means for heating said fluid heat carrier at least in part by catalytically methanizing said methanizable synthesis gas a location selected from said region and a site within the interior of said deposit in heat exchanging relationship with said fluid carrier;

(c) a preheater upstream of and communicating with said methanization reactor for effecting heat exchange between a hot methanization product gas withdrawn from said location and synthesis gas fed to said methanization reactor substantially at said location to heat said synthesis gas;

(d) a condenser upstream of said preheater but at said location for cooling with synthesis gas fed to said preheater and traversed by the product gas to condense water vapor therefrom, said synthesis gas cooling said product gas in said condenser to a temperature at most equal to the condensation temperature of water vapor in said product gas; and (e) means for recycling said product gas to the means for forming the methanizable synthesis gas.

5. The improvement defined in claim 4 wherein said means for heating said fluid heat carrier is a methanization reactor disposed at said location and through which said fluid heat carrier is fed.

6. The improvement defined in claim 4, further comprising a high-temperature nuclear reactor for heating said product gas for steam reforming.

* * * * *